United States Patent [19]

Rieben et al.

[11] 4,101,048

[45] Jul. 18, 1978

[54] PRODUCE FIELD BOX AND FOLDABLE BLANK FOR MAKING IT

[75] Inventors: Horace Johnnie Rieben, Russellville, Ak.; Lawrence F. Taylor, Bay Minnette, Ala.

[73] Assignee: International Paper Company, New York, N.Y.

[21] Appl. No.: 691,844

[22] Filed: Jun. 1, 1976

[51] Int. Cl.[2] ..... B65D 5/22; B65D 21/02

[52] U.S. Cl. ..... 229/34 R; 229/31 FS; 229/DIG. 11

[58] Field of Search ..... 229/34 R, 33, DIG. 11, 229/32, 37 R, 31 FS

[56] References Cited

U.S. PATENT DOCUMENTS

| | | | |
|---|---|---|---|
| 2,218,360 | 10/1940 | Rokol | 229/34 R |
| 2,864,545 | 12/1958 | Royce | 229/34 R |
| 3,114,493 | 12/1963 | Dunkin | 229/DIG. 11 |
| 3,820,706 | 6/1974 | Gibson et al. | 229/DIG. 11 |

FOREIGN PATENT DOCUMENTS

| | | | |
|---|---|---|---|
| 1,289,639 | 7/1962 | France | 229/DIG. 11 |

*Primary Examiner*—William Price
*Assistant Examiner*—Joseph M. Moy
*Attorney, Agent, or Firm*—Richard M. Barnes

[57] ABSTRACT

A cut and scored foldable blank and the produce field box formed from the blank. The box has double side walls and double end walls which are reinforced by two to five additional layers of foldable material. The box has two end wall top decks for stacking. Preferably the end wall top decks are raised above the side walls of the box. The box is self locking and preferably has end locking tabs which extend from the inside end wall panels parallel to the bottom panel to enhance the self locking feature of the box.

20 Claims, 7 Drawing Figures

FIG. 2
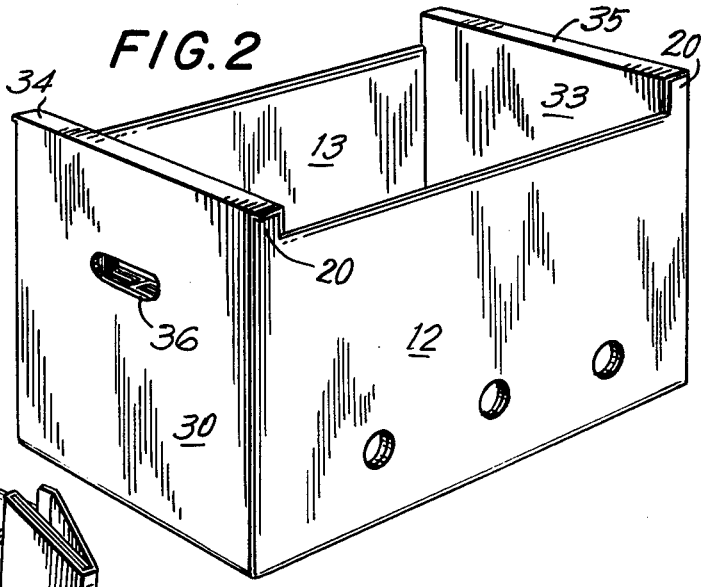
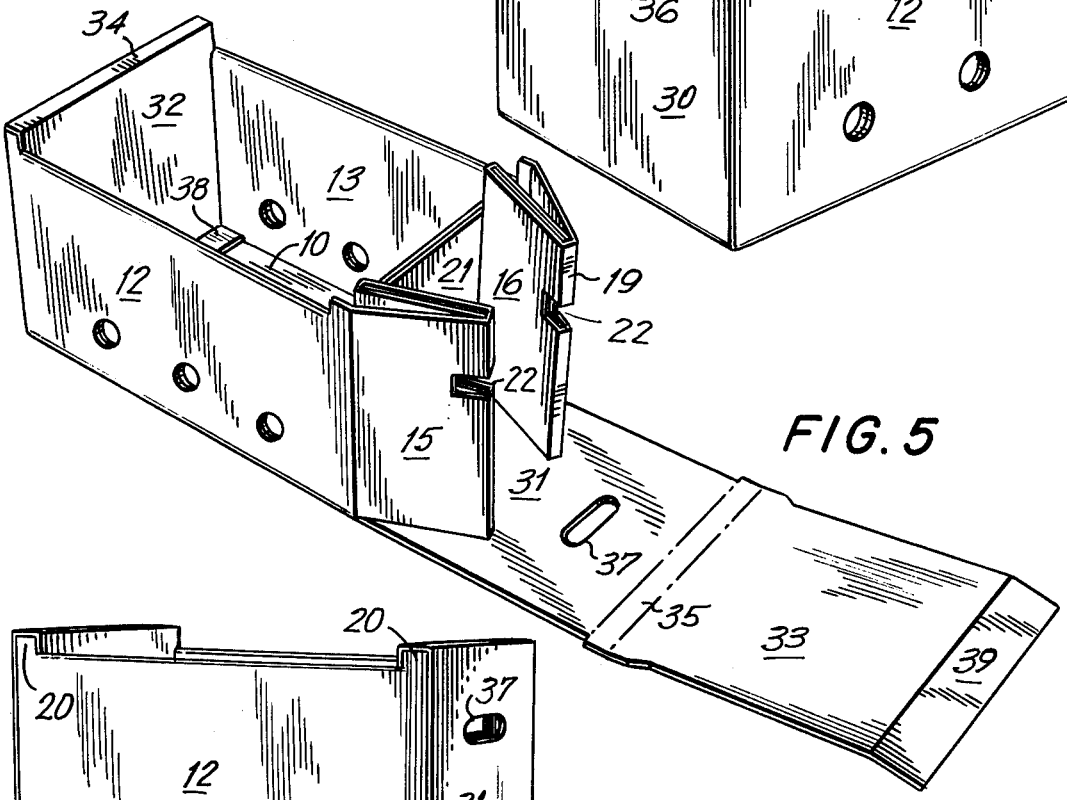
FIG. 5
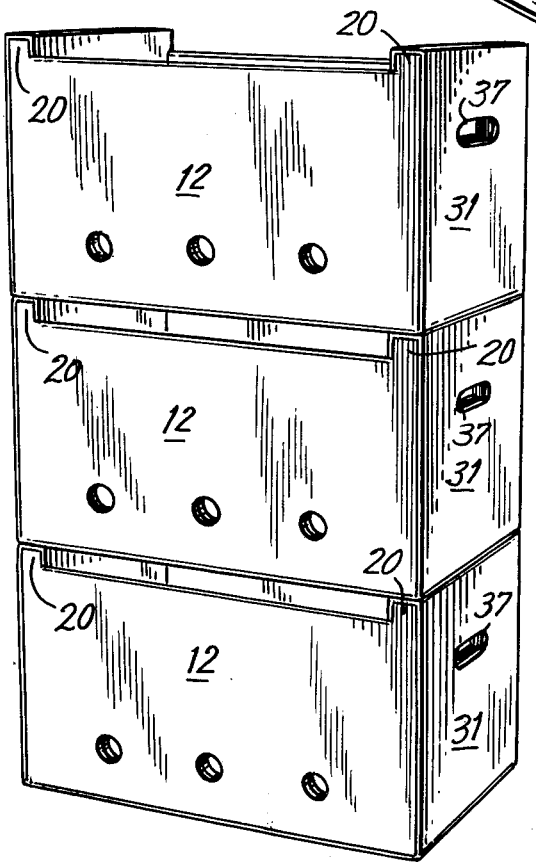
FIG. 6
FIG. 7
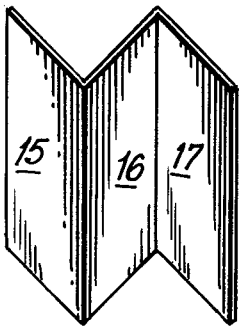

PRODUCE FIELD BOX AND FOLDABLE BLANK FOR MAKING IT

BACKGROUND OF THE INVENTION

This invention relates to a foldable blank and the reinforced box for storing produce which is produced from the blank. This invention particularly relates to a produce field box which has improved strength and impact resistence. This invention also relates to produce field boxes which may be stacked onto one another without damaging the produce stored therein. This invention further relates to a produce field box which is relatively light and inexpensive and which can be knocked down to lie flat when not in use.

Presently the produce industry is using wooden boxes to pack, store and transport produce such as tomatoes and the like. However, boxes which are constructed from wood have several disadvantages which do not exist in boxes constructed from foldable materials, such as corrugated paperboard and it therefore would be most desirable to provide a produce field box which is constructed from such materials.

One disadvantage of wooden boxes is that, because of the hardness of the wood, they tend to bruise fruit easily. A second disadvantage of wooden boxes is that they are relatively heavy and therefore relatively difficult to transport manually. Another disadvantage of wooden boxes is that they are relatively expensive. For example, a wooden box is about 3½ times more expensive than the box of the present invention produced from corrugated cardboard. Yet another disadvantage of wooden boxes is that they cannot be knocked down when not in use and, therefore, require substantial storage space during the off season. The boxes of the present invention overcome the foregoing disadvantages of wooden boxes, but yet are characterized by high strength and stacking ability.

Container and boxes which are constructed from foldable material, such as corrugated paperboard, are well known in the art. See, for example, U.S. Pat. No. 2,218,360 to Rokol, U.S. Pat. No. 2,864,545 to Royce, U.S. Pat. No. 3,310,219 to Dlugopolski and U.S. Pat. No. 3,055,569 to Layne. However, for a variety of reasons, each of these prior art boxes and containers cannot be suitably used as an all purpose produce field box.

For example, the Rokol construction is not entirely satisfactory for use as a produce field box for a number of reasons. First, as is well known in the art, produce field boxes are frequently overpacked in the field. In prior art boxes this results in a packed box which has produce extending above the side and end walls of the container, and such boxes, of course, cannot be stacked one upon the other without damaging the produce stored. In contrast, the produce field box of the present invention preferably has raised end wall stacking panels upon which the boxes are stacked one upon the other. The produce can thereby extend above the sidewalls of the box without being damaged upon stacking.

The Rokol construction is also deficient when heavy loads are to be stacked because the end wall construction of the Rokol construction comprises at most four layers of foldable material, and as a result is not strong enough to withstand heavy loads. In contrast, the end wall construction of the produce field box of the present invention may comprise up to 7 layers of foldable material, with the result that substantially heavier loads can be stacked in the boxes of the present invention than in the boxes of Rokol.

SUMMARY OF THE INVENTION

In accordance with this invention, a cut and scored foldable blank for a produce field box is provided. The blank of one preferred embodiment comprises:

- a bottom panel;
- first and second outside side wall panels connected to opposite sides of the bottom panel;
- a first inside side wall panel, said first inside side wall panel connected to said first outside side wall panel opposite to said bottom panel;
- a second inside side wall panel, said second inside side wall panel connected to said second outside side wall panel opposite to said bottom panel;
- a first set of two first end wall stacking panels comprising a first, first end wall stacking panel and a second, first end wall stacking panel connected to opposite sides of the first outside side wall panel;
- a second set of two first end wall stacking panels comprising a first, first end wall stacking panel and a second, first end wall stacking panel connected to opposite sides of the second outside side wall panel;
- four second end wall stacking panels, each of said second end wall stacking panels connected to a different first end wall stacking panel opposite to an outside side wall panel;
- four third end wall stacking panels, each of said third end wall stacking panels connected to a different second end wall stacking panel opposite to a first end wall stacking panel;
- first and second outside end wall panels connected to opposite sides of the bottom panel;
- a first inside end wall panel, said first inside end wall panel connected by a first end wall top deck panel to said first outside end wall panel;
- a second inside end wall panel, said second inside end wall panel connected by a second end wall top deck panel to said second outside end wall panel.

The blank of another preferred embodiment comprises:

- a bottom panel;
- first and second outside end wall panels connected to opposite sides of the bottom panel;
- a first inside end wall panel, said first inside end wall panel connected by a first end wall top deck panel to said first outside end wall panel;
- a second inside end wall panel, said inside end wall panel connected by a second end wall top deck panel to said second outside end wall panel;
- first and second outside side wall panels connected to opposite sides of the bottom panel, wherein the corners of the first and second outside side wall panels which are remote from the bottom panel project away from said bottom panel whereby said corners of the first and second outside side wall help to support the first and second end wall top deck panels when the blank is folded into a produce field box;
- a first inside side wall panel, said first inside side wall panel connected to said first outside side wall panel opposite to said bottom panel;
- a second inside side wall panel, said second inside side wall panel connected to said second outside side wall panel opposite to said bottom panel;
- a first set of two first end wall stacking panels comprising a first, first end wall stacking panel and a second, first end wall stacking panel connected to opposite sides of the first outside side wall panel;

a second set of two first end wall stacking panels comprising a first, first end wall stacking panel and a second, first end wall stacking panel connected to opposite sides of the second outside side wall panel;

four second end wall stacking panels, each of said second end wall stacking panels connected to a different first end wall stacking panel opposite to an outside side wall panel.

The produce field boxes which are constructed from the foregoing blanks have double side walls and double end walls which may be reinforced by two to five additional layers of foldable material. Additionally, the box has two end wall top decks for stacking one box upon another. Preferably the end wall top decks are raised above the side walls of the box. The box according to one preferred embodiment of the present invention comprises:

a bottom panel;

first and second outside side wall panels connected to opposite sides of the bottom panel;

a first inside side wall panel, said first inside side wall panel connected to and folded substantially parallel to first outside side wall panel;

a second inside side wall panel, said second inside side wall panel connected to and folded substantially parallel to said second outside side wall panel;

first and second outside end wall panels connected to opposite sides of the bottom panel;

a first inside end wall panel folded substantially parallel to said first outside end wall panel;

a first end wall top deck panel connecting said first outside end wall panel and said first inside end wall panel and folded substantially parallel to said bottom panel;

a second inside end wall panel folded substantially parallel to said second outside end wall panel;

a second end wall top deck panel connecting said second outside end wall panel and said second inside end wall panel and folded substantially parallel to said bottom panel;

a first set of two first end wall stacking panels comprising a first, first end wall stacking panel connected to said first outside side wall panel and foldably sandwiched between said first outside end wall panel and said first inside end wall panel and a second, first end wall stacking panel connected to said first outside side wall panel and foldably sandwiched between said second outside end wall panel and said second inside end wall panel;

a second set of two first end wall stacking panels comprising a first, first end wall stacking panel connected to said second outside side wall panel and foldably sandwiched between said first outside end wall panel and said first inside end wall panel, and a second, first end wall stacking panel connected to said second outside side wall panel and foldably sandwiched between said second outside end wall panel and said second inside end wall panel;

four second end wall stacking panels, each of said second end wall stacking panels connected to and folded substantially parallel to a different first end wall stacking panel;

four third end wall stacking panels, each said third end wall stacking panel connected to and folded substantially parallel to a different second end wall stacking panel.

The box according to another preferred embodiment of the invention comprises:

a bottom panel;

first and second outside end wall panels connected to opposite sides of the bottom panel;

a first inside end wall panel connected to and folded substantially parallel to said first outside end wall panel;

a first end wall top deck panel connecting said first outside end wall panel and said first inside end wall panel and folded substantially parallel to said bottom panel;

a second inside end wall panel connected to and folded substantially parallel to said second outside end wall panel;

a second end wall top deck panel connecting said second outside end wall panel and said second inside end wall panel and folded substantially parallel to said bottom panel;

first and second outside side wall panels connected to oppositel sides of the bottom panel, wherein the corners of the first and second outside side wall panels which are remote from the bottom panel project away from said bottom panel whereby said corners help to support the first and second end wall top deck panels;

a first inside side wall panel, said first inside side wall panel connected to and folded substantially parallel to said first outside side wall panel;

a second inside side wall panel, said second inside side wall panel connected to and folded substantially parallel to said second outside side wall panel;

a first set of two first end wall stacking panels comprising a first, first end wall stacking panel connected to said first outside side wall panel and foldably sandwiched between said first outside side wall panel and said first inside end wall panel, and a second first end wall stacking panel, connected to said first outside side wall panel and foldably sandwiched between said second outside end wall panel and said second inside end wall panel;

a second set of two first end wall stacking panels comprising a first, first end wall stacking panel connected to said second outside side wall panel and foldably sandwiched between said first outside end wall panel and said first inside end wall panel, and a second, first end wall stacking panel connected to said second outside side wall panel and foldably sandwiched between said second outside end wall panel and said second inside end wall panel;

four second end wall stacking panels, each of said second end wall stacking panels connected to and folded substantially parallel to a different first end wall stacking panel.

BRIEF DESCRIPTION OF THE DRAWINGS

FIG. 2 is a perspective view of an erected container according to the present invention.

FIG. 5 is a perspective view of a partially assembled container constructed from the partially assembled container shown in FIG. 4.

FIG. 6 is a perspective view of three erected containers of the present invention which are stacked one upon another.

FIG. 7 illustrates an alternative manner of folding the first, second and third end wall stacking panels of the present invention with respect to one another.

DESCRIPTION OF THE PREFERRED EMBODIMENTS

Figure 1:
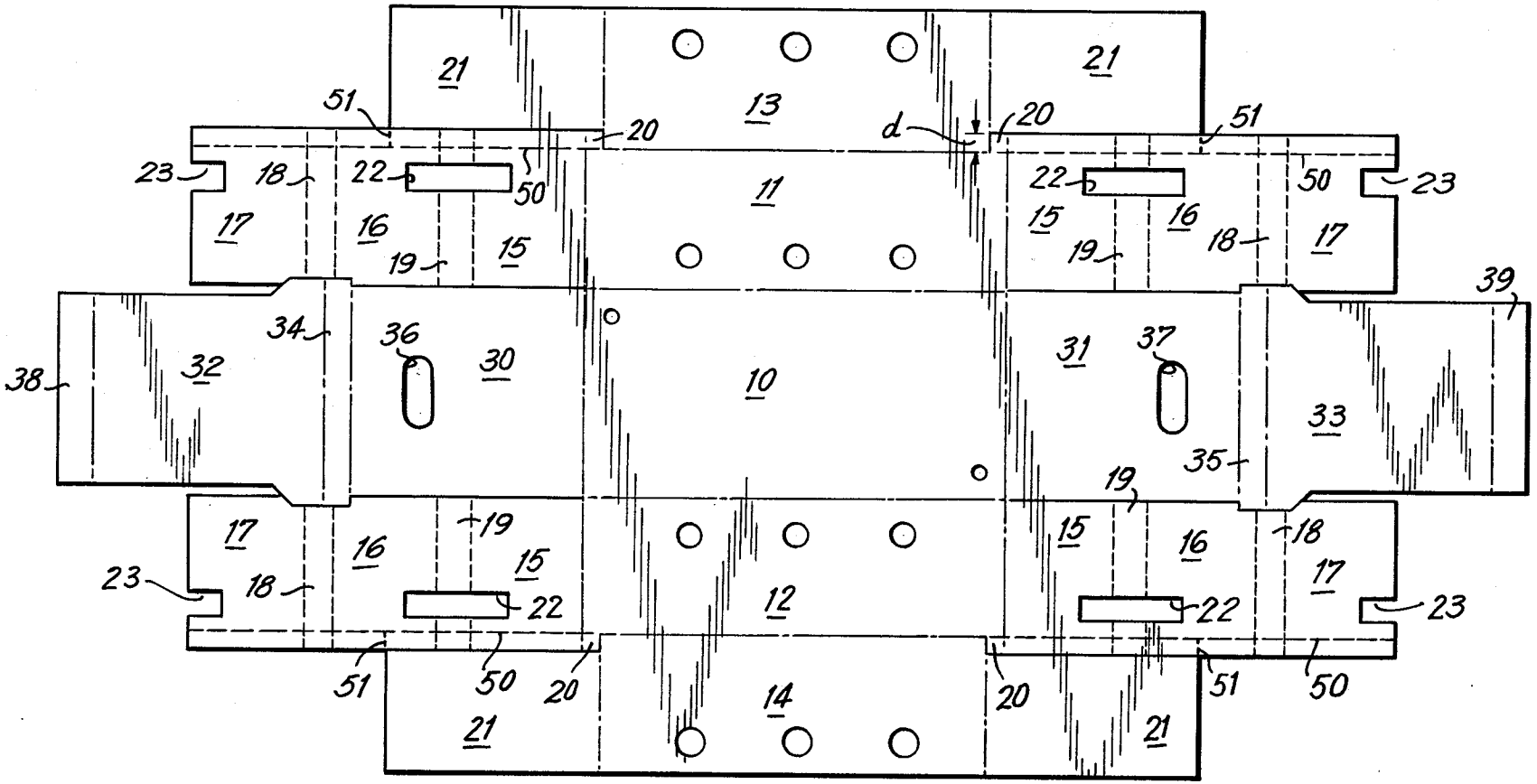
FIG. 1 is a plan view of the blank of the most preferred embodiment of the present invention.

Referring now to FIGS. 1 and 2 there are shown respectively the blank of the present invention and the box which is constructed from the blank. As shown in FIG. 1, first and second outside wall panels 11 and 12 are connected to opposite sides of bottom panel 10. As shown in FIGS. 1 and 2 the corners 20 of the first and second outside side wall panels which are remote from the bottom panel 10 project away from the bottom panel whereby, when the blank is folded into a box, the corners of the first and second outside side wall panels help to support hereinafter described raised end wall top deck panels 34 and 35. While the distance, "*d*", that the corners 20 project from the body of the outside side wall panels may of course vary, it is preferred that the distance, "*d*", be between about 0.5 and 1.5 inches and most preferably be about 1 inch.

A first inside side wall panel 13 is connected to the first outside side wall panel 11 opposite to bottom panel 10. Likewise, a second inside side wall panel 14 is connected to the second outside side wall panel 12 opposite to bottom panel 10.

The blank of the present invention further comprises first and second outside end wall panels, 30 and 31 connected to opposite sides of the bottom panel 10. A first inside end wall panel 32 is connected by a first end wall top deck panel 34 to the first outside end wall panel 30. A second inside end wall panel 33 is connected by a second end wall top deck panel 35 to the second outside end wall panel 31. As shown in FIG. 1, the first and second outside end panels are preferably provided with handle holes 36 and 37.

As shown in FIG. 1, two first end wall stacking panels 15 are foldably connected to opposite sides of both the first and second outside side wall panels 11 and 12. In turn, a second end wall stacking panel 16 is foldably connected to each of the first end wall stacking panels 15. In the most preferred embodiment of the invention, a third end wall stacking panel 17 is foldably connected to each of the second end wall stacking panels 16. Preferably the first and second end wall stacking panels are foldably connected to each other by connecting flaps 19, and the second and third end wall stacking panels are foldably connected to each other by connecting flaps 18.

As shown in FIG. 1, connecting flaps 19 and 18 are preferably defined by perforated score lines. The reason for this is that the perforated score lines render it easier to fold the first, second and third end wall stacking panels 15, 16 and 17 so that they are substantially parallel to one another.

Figure 3:
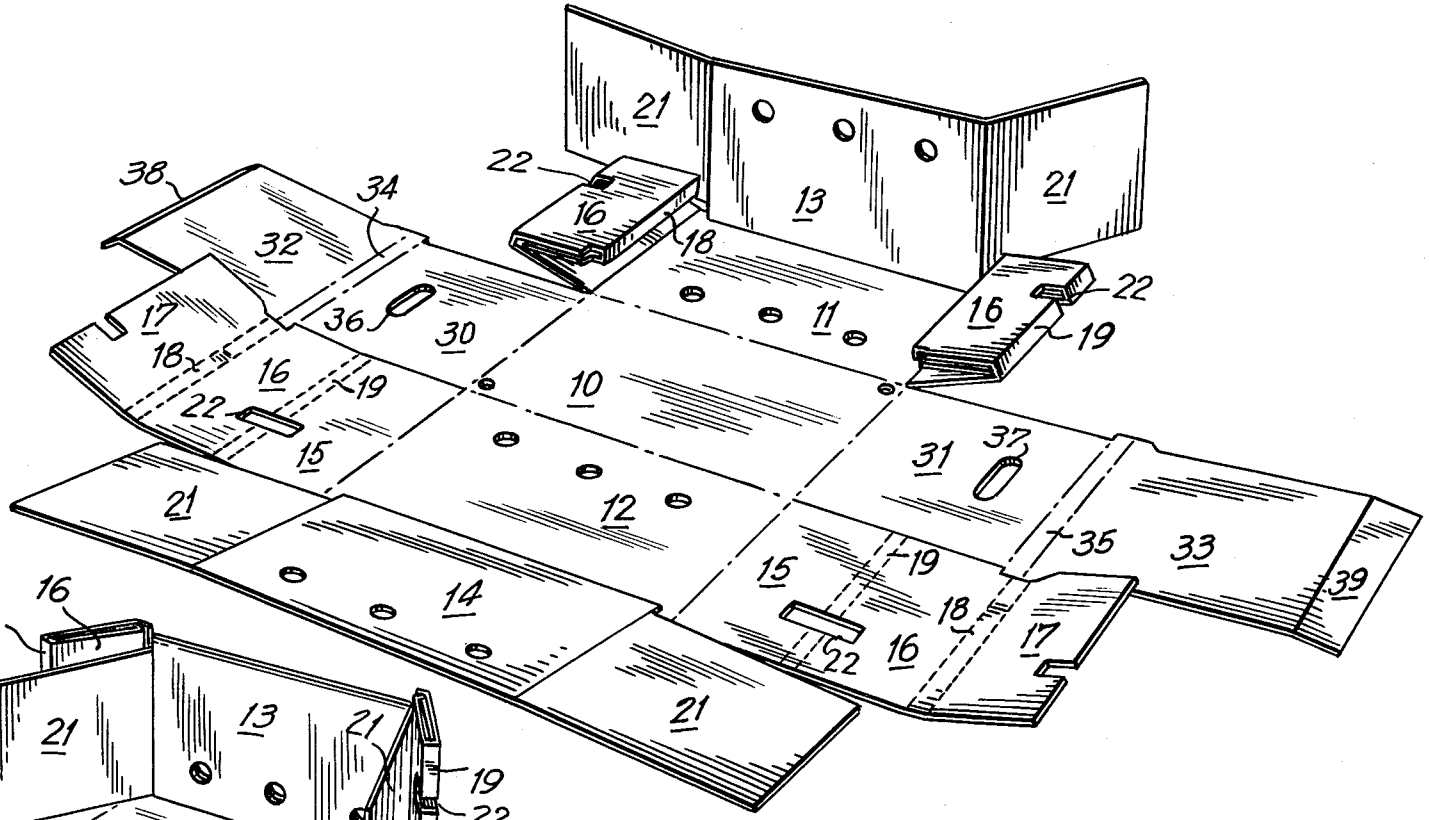
FIG. 3 is a perspective view of a partially assembled container constructed from the blank shown in FIG. 1.
Figure 4:
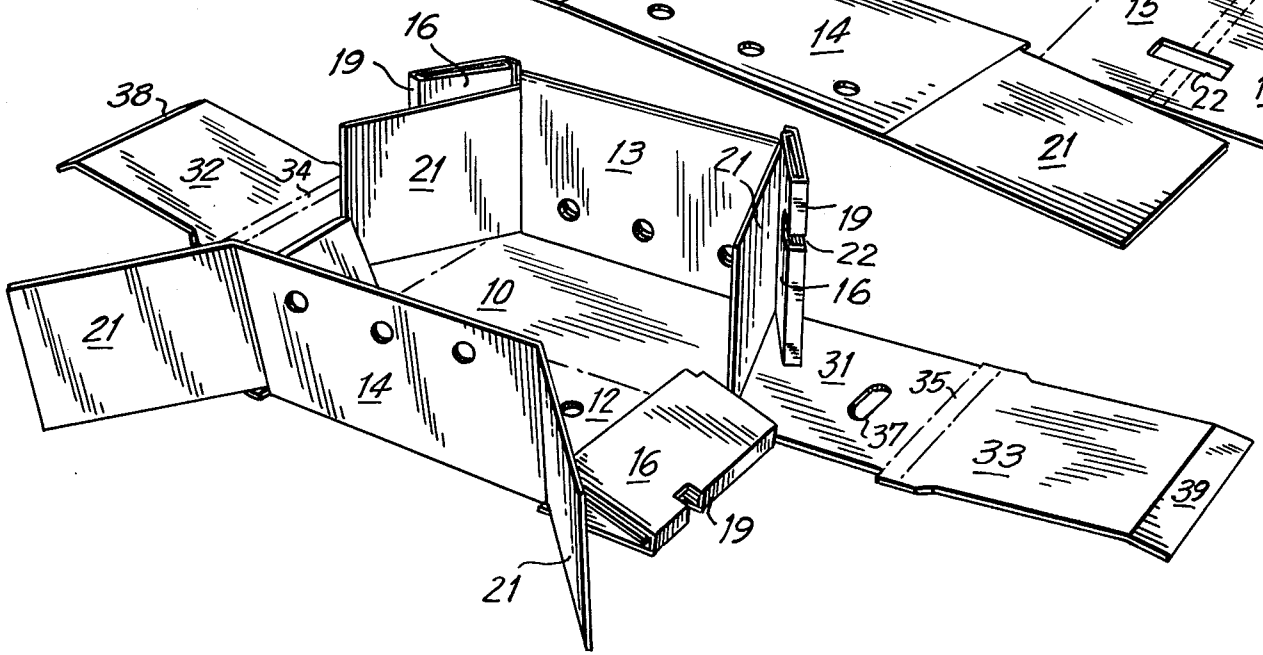
FIG. 4 is a perspective view of a partially assembled container, constructed from the partially assembled container shown in FIG. 3.

As best seen in FIGS. 3 to 5, the first, second and third end wall stacking panels 15, 16 and 17 are folded substantially parallel to one another in the constructed box of the present invention. Further, the first, second and third end wall stacking panels 15, 16 and 17 are sandwiched between either the first outside end wall panel 30 and the first inside end wall panel 32 or the second outside end wall panel 31 and the second inside end wall panel 33. As best seen from FIGS. 2, 4 and 5 the first, second and third end wall panels 15, 16 and 17 are designed and arranged in the constructed box to help support any load which is placed on the first or second end wall top deck panels 34 and 35. It will be understood that while three end wall stacking panels are illustrated in the drawings and are preferred, adequate strength and support can sometimes be obtained with only two end wall stacking panels.

As best seen in FIGS. 1, 2, 4, and 5, the first, second and third end wall stacking panels 15, 16 and 17, as well as connecting panel 19, are preferably provided with cut out portions 22 and 23 so that when the blank is folded into the box and cut out portions are in alignment with the first and second handle holes 36 and 37 which are preferably provided in first and second outside end wall panels 30 and 31.

The first, second and third end wall stacking panels 15, 16 and 17 are provided to give the box of the present invention added strength and support. In the most preferred embodiment of the present invention, as shown in FIG. 1, additional strength is given to the box by providing four side wall reinforcing panels 21 connected to opposite sides of the first and second inside side wall panels 13 and 14. As best seen in FIGS. 3 to 5, each of the end wall reinforcing panels 21 is folded substantially parallel to another end wall reinforcing panel and sandwiched between either the first outside end wall panel 30 and the first inside end wall panel 32 or the second outside end wall panel 31 and the second inside end wall panel 33.

When the corners 20 of the first and second outside side wall panels 11 and 12 project away from the bottom panel as shown in FIG. 2, it will be appreciated that the sole function of the end wall reinforcing panels is to reinforce the end walls of the box. However, when the first and second outside side wall panels 11 and 12 do not have corners 20, then the reinforcing panels 21, first, second and third end wall stacking panels 15 to 17 and connecting flaps 18 and 19 are desirably modified as shown by dotted lines 50 and 51 as shown in FIG. 1. It will be appreciated that with these modifications, the first and second end wall top deck panels will not be raised above the level of the top of the side wall panels 11–14 and that then the end wall reinforcing panels 21 will function to help support any load which is placed on end wall top deck panels 34 and 35.

The box which is produced from the blank which has been hereinbefore described in self-locking. However, in the most preferred embodiment of the present invention there is provided first and second end locking tabs 38 and 39 which are foldably connected to first and second inside end walls 32 and 33 respectively. As best seen in FIG. 5, in the constructed box the end locking tabs 38 and 39 are folded substantially parallel to the bottom panel 10 of the box in close abutment with the lower inside walls of inside side walls 13 and 14. In this fashion the end locking tabs 38 and 39 help to maintain the inside side walls 13 and 14 in place.

Referring now to FIG. 6, there is shown a perspective view of three erected containers of the most preferred embodiment of the present invention which are stacked one upon the other. It will be appreciated upon reference to FIG. 6 that the top two containers rest on the end wall top deck panels 34 and 35 of the container below it. It will further be appreciated that the first, second and third end wall stacking panels 15, 16 and 17 as well as the first and second outside end wall panels 30 and 31 and the first and second inside end walls 32 and 33 help to support the loads which are placed upon the end wall top deck panels 34 and 35. It will also be appreciated that when the boxes shown in FIG. 6 are somewhat overpacked with produce, such as tomatoes and the like, the produce will not be damaged during stacking because of the raised end wall top deck panels of the box. This is a very important feature of the present invention because produce field boxes are frequently over packed and it is most desirable to prevent damage that would otherwise result upon stacking of overpacked boxes.

The embodiments described above are only illustrative of the most preferred embodiments and it should be understood that these embodiments may be somewhat modified and still be within the scope of the present invention. For example, referring to FIG. 7 there is illustrated an alternative manner of folding the first, second, and third end wall stacking panels 15, 16 and 17 of the present invention. It will be noted that the manner of folding the end wall stacking panels illustrated in FIG. 7 does not require connecting flaps 18 and 19. It will of course be appreciated by those skilled in the art that the blank used in this embodiment must be appropriately scored to permit the folding shown in FIG. 7.

It is believed that the invention and many of its attendant advantages will be understood from the foregoing description, and it will be apparent that various changes may be made in the form, construction and arrangement of the parts without departing from the spirit and scope of the invention as defined in the appended claims, the forms hereinbefore described being preferred embodiments thereof.

We claim:

1. A cut and scored foldable blank for a produce field box, which comprises:

a bottom panel;

first and second outside end wall panels connected to opposite sides of the bottom panel;

a first inside end wall panel, said first inside end wall panel connected by a first end wall top deck panel to said first outside end wall panel;

a second inside end wall panel, said inside end wall panel connected by a second end wall top deck panel to said second outside end wall panel;

first and second outside side wall panels connected to opposite sides of the bottom panel, wherein the corners of the first and second outside side wall panels which are remote from the bottom panel project away from said bottom panel whereby said corners of the first and second outside side wall help to support the first and second end wall top deck panels when the blank is folded into a produce field box;

a first inside side wall panel, said first inside side wall panel connected to said first outside side wall panel opposite to said bottom panel;

a second inside side wall panel, said second inside side wall panel connected to said second outside side wall panel opposite to said bottom panel;

a first set of two first end wall stacking panels comprising a first, first end wall stacking panel and a second, first end wall stacking panel connected to opposite sides of the first outside side wall panel;

a second set of two first end wall stacking panels comprising a first, first end wall stacking panel and a second, first end wall stacking panel connected to opposite sides of the second outside side wall panel whereby, when the blank is folded into a produce field box, each of said first end wall stacking panels helps to support an end wall top deck panel when a load is stacked on said end wall top deck panel;

four second end wall stacking panels, each of said second end wall stacking panels connected to a different first end wall stacking panel on the opposite side that the outside side wall panel is connected whereby, when the blank is folded into a produce field box, each of said second end wall stacking panels helps to support an end wall stacking panel when a load is stacked on said end wall top deck panel.

2. The blank of claim 1 further comprising four third end wall stacking panels, each of said third end wall stacking panels connected to a different second end wall stacking panel on the opposite side that the first end wall stacking panel is connected.

3. The blank of claim 2 wherein each of said first end wall stacking panels is connected to its corresponding second end wall stacking panel by a connecting flap, and each of said second end wall stacking panels is connected to its corresponding third end wall stacking panel by a connecting flap.

4. The blank of claim 3 further comprising a first end locking tab connected to the first inside end wall panel opposite to said first end wall top deck panel and a second end locking tab connected to said second inside end wall panel opposite to said second end wall top deck panel.

5. The blank of claim 1 further comprising a first end locking tab connected to the first inside end wall panel opposite to said first end wall top deck panel and a second end locking tab connected to said second inside end wall panel opposite to said second end wall top deck panel.

6. The blank of claim 1 further comprising:

a first, first end wall reinforcing panel and a second, first end wall reinforcing panel connected to opposite sides of the first inside side wall panel;

a first, second end wall reinforcing panel and a second, second end wall reinforcing panel connected to opposite sides of the second inside side wall panel.

7. The blank of claim 1 wherein the blank is made from corrugated cardboard.

8. The blank of claim 1 wherein the corners of said outside side wall panels project away from said bottom panel about 0.5 to about 1.5 inches.

9. The blank of claim 1 wherein said first and second end wall stacking panels may be foldably sandwiched between said inside and outside end wall panels so that the distance between said first and second outside side wall panels is substantially bridged by said first and second end wall stacking panels.

10. A box for storing produce constructed from foldable material comprising:

a bottom panel;

first and second outside end wall panels connected to opposite sides of the bottom panel;

a first inside end wall panel connected to and folded substantially parallel to said first outside end wall panel;

a first end wall top deck panel connecting said first outside end wall panel and said first inside end wall panel and folded substantially parallel to said bottom panel;

a second inside end wall panel connected to and folded substantially parallel to said second outside end wall panel;

a second end wall top deck panel connecting said second outside end wall panel and said second inside end wall panel and folded substantially parallel to said bottom panel;

first and second outside side wall panels connected to opposite sides of the bottom panel, wherein the corners of the first and second outside side wall panels which are remote from the bottom panel project away from said bottom panel whereby said corners help to support the first and second end wall top deck panels;

a first inside side wall panel, said first inside side wall panel connected to and folded substantially parallel to said first outside side wall panel;

a second side wall panel, said second inside side wall panel connected to and folded substantially parallel to said second outside side wall panel;

a first set of two first end wall stacking panels comprising a first, first end wall stacking panel connected to said first outside side wall panel and foldably sandwiched between said first outside end wall panel and said first inside end wall panel, and a second first end wall stacking panel, connected to said first outside side wall panel and foldably sandwiched between said second outside end wall panel and said second inside end wall panel;

a second set of two first end wall stacking panels comprising a first, first end wall stacking panel connected to said second outside side wall panel and foldably sandwiched between said first outside end wall panel and said first inside end wall panel, and a second, first end wall stacking panel connected to said second outside side wall panel and foldably sandwiched between said second outside end wall panel and said second inside end wall panel whereby each of said first end wall stacking panels helps to support an end wall top deck panel when a load is stacked on said end wall top deck panel;

four second end wall stacking panels, each of said second end wall stacking panels connected to and folded substantially parallel to a different first end wall stacking panel on the opposite side that the outside side wall panel is connected, whereby each of said second end wall stacking panels helps to support a top deck panel when a load is stacked on said end wall top deck panel.

11. The box of claim 10 further comprising four, third end wall stacking panels, each of said third end wall stacking panels connected to and folded substantially parallel to a different second end wall stacking panel.

12. The box of claim 11 wherein each of said first end wall stacking panels is connected to its corresponding second end wall stacking panel by a connecting flap, and each of said second end wall stacking panels is connected to its corresponding third end wall stacking panel by a connecting flap.

13. The box of claim 10 further comprising a first end locking tab connected to the first inside end wall panel and folded substantially parallel to said bottom panel, and a second end locking tab connected to the second inside end wall panel and folded substantially parallel to said bottom panel.

14. The box of claim 10 further comprising:

a first, first end wall reinforcing panel and a second, first end wall reinforcing panel connected to opposite sides of the first inside side wall panel, said first, first end wall reinforcing panel foldably sandwiched between said first outside end wall panel and said first inside end wall panel and said second, first end wall reinforcing panel foldably sandwiched between said second outside end wall panel and said second inside end wall panel;

a first, second end wall reinforcing panel and a second, second end wall reinforcing panel connected to opposite sides of the second inside side wall panel, said first, second end wall reinforcing panel foldably sandwiched between said first outside end wall panel and said first inside end wall panel and said second, second end wall reinforcing panel foldably sandwiched between said second outside end wall panel and said second inside end wall panel.

15. The box of claim 12 comprising:

a first, first end wall reinforcing panel and a second, first end wall reinforcing panel connected to opposite sides of the first inside side wall panel, said first, first end wall reinforcing panel foldably sandwiched between said first outside end wall panel and said first inside side wall panel and said second, first end wall reinforcing panel foldably sandwiched between said second outside end wall panel and said second inside end wall panel;

a first, second end wall reinforcing panel and a second, second end wall reinforcing panel connected to opposite sides of the second inside side wall panel, said first, second end wall reinforcing panel foldably sandwiched between said first outside end wall panel and said first inside end wall panel and said second, second end wall reinforcing panel foldably sandwiched between said second outside end wall panel and said second inside end wall panel.

16. The box of claim 10 wherein the foldable material is corrugated paperboard.

17. The box of claim 10 wherein the first and second outside end wall panel is provided with a hole.

18. The box of claim 17 wherein each of the first end wall stacking panels and each of the second end wall stacking panels are provided with a cut out portion which is in alignment with a portion of a hole in one of the outside end wall panels.

19. The box of claim 10 wherein the corners of said outside side wall panels project away from said bottom panel about 0.5 to about 1.5 inches.

20. The box of claim 10 wherein said first and second end wall stacking panels are foldably sandwiched between said inside and outside end wall panels so that the distance between said first and second outside side wall panels is substantially bridged by said first and second end wall stacking panels.

* * * * *